US011488530B2

(12) United States Patent
Wang et al.

(10) Patent No.: US 11,488,530 B2
(45) Date of Patent: Nov. 1, 2022

(54) PIXEL CIRCUIT, DRIVING METHOD THEREOF AND DISPLAY DEVICE

(71) Applicant: WUHAN CHINA STAR OPTOELECTRONICS SEMICONDUCTOR DISPLAY TECHNOLOGY CO., LTD., Wuhan (CN)

(72) Inventors: Xuanyun Wang, Wuhan (CN); Sunghwan Cho, Wuhan (CN); Chao Dai, Wuhan (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 23 days.

(21) Appl. No.: 17/261,702

(22) PCT Filed: Sep. 17, 2020

(86) PCT No.: PCT/CN2020/115788

§ 371 (c)(1),
(2) Date: Jan. 20, 2021

(87) PCT Pub. No.: WO2022/011825

PCT Pub. Date: Jan. 20, 2022

(65) Prior Publication Data

US 2022/0157238 A1 May 19, 2022

(30) Foreign Application Priority Data

Jul. 15, 2020 (CN) ..... 202010681405.1

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
None
See application file for complete search history.

(56) References Cited

U.S. PATENT DOCUMENTS

2011/0157144 A1* 6/2011 Park ..... G09G 3/3233 345/212
2012/0019504 A1* 1/2012 Han ..... G09G 3/3233 345/212

(Continued)

FOREIGN PATENT DOCUMENTS

CN 104575367 A 4/2015
CN 108133687 A 6/2018

(Continued)

*Primary Examiner* — Dorothy Harris
(74) *Attorney, Agent, or Firm* — The Roy Gross Law Firm, LLC; Roy Gross

(57) ABSTRACT

The present application provides a pixel circuit, a driving method thereof and a display device. An anti-leakage transistor is added between the gate of the driving transistor and the initialization transistor and between the gate of the driving transistor and the compensation transistor. The anti-leakage transistor includes an active layer with oxide semiconductor. Low leakage property of a metal oxide transistor is utilized to suppress potential changes of the gate of the driving transistor during a light-emitting diode emits light.

11 Claims, 5 Drawing Sheets

(52) U.S. Cl.
CPC . *G09G 2300/0861* (2013.01); *G09G 2310/08* (2013.01); *G09G 2320/0247* (2013.01); *G09G 2320/045* (2013.01); *G09G 2330/021* (2013.01)

(56) References Cited

U.S. PATENT DOCUMENTS

| | | | | |
|---|---|---|---|---|
| 2012/0038683 | A1* | 2/2012 | Park | G09G 3/3233 345/77 |
| 2015/0154941 | A1 | 6/2015 | Kanda et al. | |
| 2018/0006099 | A1* | 1/2018 | Ka | H01L 27/3248 |
| 2018/0158407 | A1* | 6/2018 | Chai | G09G 3/3233 |

FOREIGN PATENT DOCUMENTS

| | | | |
|---|---|---|---|
| CN | 110085170 | A | 8/2019 |
| CN | 111599309 | A | 8/2020 |
| CN | 111627387 | A | 9/2020 |
| CN | 111754938 | A | 10/2020 |
| CN | 212276788 | U | 1/2021 |
| KR | 20060041045 | A | 5/2006 |

* cited by examiner

PIXEL CIRCUIT, DRIVING METHOD THEREOF AND DISPLAY DEVICE

CROSS REFERENCE TO RELATED APPLICATIONS

This application is a National Phase of PCT Patent Application No. PCT/CN2020/115788 having International filing date of Sep. 17, 2020, which claims the benefit of priority of Chinese Application No. 202010681405.1 filed Jul. 15, 2020. The contents of the above applications are all incorporated by reference as if fully set forth herein in their entirety.

FIELD OF THE DISCLOSURE

The present application relates to display technologies, and more particularly to a pixel circuit, a driving method thereof and a display device.

DESCRIPTION OF RELATED ARTS

FIG. 1 is an equivalent circuit diagram of a pixel circuit for a conventional signal pixel. For a single pixel, the pixel circuit includes a driving transistor T1, a switching transistor T2, a compensation transistor T3, an initialization transistor T4, a first light-emitting control transistor T5, a second light-emitting control transistor T6, a restoration transistor T7, a storage capacitor C and an organic light-emitting diode OLED. The control end of the driving transistor T1 is connected to the first end of the storage capacitor C, the first end of the compensation transistor T3, and the first end of the initialization transistor T4. The first end of the driving transistor T1 is connected to a first power supply voltage end ELVDD via the first light-emitting control transistor T5. The second end of the driving transistor T1 is connected to the anode of the organic light-emitting diode OLED via the second light-emitting control transistor T6. The first end of the switching transistor T2 is connected to the data signal end Data. The second end of the switching transistor T2 is connected to the first end of the driving transistor T1. The control end of the switching transistor T2 is connected to the n-th scan signal end Scan(n), where n is an integer greater than or equal to 2. The control end of the compensation transistor T3 is connected to the n-th scan signal end Scan(n). The first end of the compensation transistor T3 is connected to the control end of the driving transistor T1. The second end of the compensation transistor T3 is connected to the second end of the driving transistor T1. The control end of the initialization transistor T4 is connected to the (n−1)-th scan signal end Scan(n−1). The first end of the initialization transistor T4 is connected to the control end of the drive transistor T1. The second end of the initialization transistor T4 is connected to the initialization signal end Vint. Both the control end of the first light-emitting control transistor T5 and the control end of the second light-emitting control transistor T6 are connected to the light-emitting control signal end EM. The control end of the restoration transistor T7 is connected to the n-th scan signal end Scan(n). The first end of the restoration transistor T7 is connected to the anode of the organic light-emitting diode OLED. The second end of the restoration transistor T7 is connected to the initialization signal end Vint. The cathode of the organic light-emitting diode OLED is connected to the second power supply voltage end ELVSS. All the driving transistor T1, the switching transistor T2, the compensation transistor T3, the initialization transistor T4, the first light-emitting control transistor T5, the second light-emitting control transistor T6 and the restoration transistor T7 are P-type thin-film transistors having an active layer with low-temperature polysilicon. The fatal weakness of low-temperature polysilicon thin-film transistors is that they have large leakage current even though both the compensation transistor T3 and the initialization transistor T4 are dual-gate transistors, and a dual-gate transistor has a smaller leakage current than an ordinary transistor. However, during the driving transistor T1 drives the organic light-emitting diode, at the time the compensation transistor T3 and the initialization transistor T4 that are dual-gate transistors are switched off, there is still a leakage current flowing through the compensation transistor T3 and the initialization transistor T4, resulting in voltage variations of the gate of the driving transistor T1. The leakage current will cause serious flickers when displayed at low frequency.

Therefore, there is a need to propose a technical solution to solve the problem of low-frequency displaying due to voltage variations of the gate of the driving transistor T1, caused by electric leakage occurred when the compensation transistor T3 and the initialization transistor T4 are switched off.

Technical Problems

The objective of the present application is to provide a pixel circuit, a driving method thereof, a display device, for solving the problem of low-frequency displaying due to voltage variations of the gate of the driving transistor, caused by electric leakage occurred when the compensation transistor and the initialization transistor are switched off.

Technical Solutions

To achieve above objective, the present application provides a pixel circuit, including:

a light-emitting diode;

a driving transistor, wherein a first end of the driving transistor is electrically connected to the light-emitting diode, a control end of the driving transistor is connected to a first node, and the driving transistor is configured to control operation state of the light-emitting diode based on a potential of the first node;

an anti-leakage transistor, wherein the first end of the anti-leakage transistor is connected to the first node, a second end of the anti-leakage transistor is connected to a second node, and the anti-leakage transistor includes an active layer with oxide semiconductor and is in switched-off state when the light-emitting diode is in light-emitting state;

an initialization transistor, wherein the first end of the initialization transistor is connected to the second node, the second end of the initialization transistor is connected to an initialization signal line, and the initialization transistor is configured to transmit an initialization signal input from the initialization signal line to the first node; and a compensation transistor, wherein the first end of the compensation transistor is connected to the first end of the driving transistor, the second end of the compensation transistor is connected to the second node, and the compensation transistor is configured to enable the first end of the driving transistor and the control end of the driving transistor to be electrically connected.

In the afore-mentioned pixel circuit, the pixel circuit further includes a reset transistor, wherein the first end of the reset transistor is connected to the second node, the second end of the reset transistor is connected to the initialization signal line, and the reset transistor is configured to be switched on based on a first control signal and transmit a fixed reference voltage input from the initialization signal line to the second node when the light-emitting diode is in the light-emitting state.

In the afore-mentioned pixel circuit, the reset transistor includes an active layer with low-temperature polysilicon.

In the afore-mentioned pixel circuit, the anti-leakage transistor is configured to be in the switched-off state based on the first control signal when the light-emitting diode is in the light-emitting state, and wherein the anti-leakage transistor is an N-type transistor and the reset transistor is a P-type transistor.

In the afore-mentioned pixel circuit, the anti-leakage transistor is configured to be in the switched-off state based on a second control signal when the light-emitting diode is in the light-emitting state;

the initialization transistor is configured to transmit the initialization signal input from the initialization signal line to the first node based on a third control signal;

the compensation transistor is configured to enable the first end of the driving transistor and the control end of the driving transistor to be electrically connected based on a fourth control signal;

the first control signal, the second control signal, the third control signal, and the fourth control signal are different from each other.

In the afore-mentioned pixel circuit, the pixel circuit further includes a restoration transistor, wherein the first end of the restoration transistor is connected to an anode of the light-emitting diode, the second end of the restoration transistor is connected to the first end of the initialization transistor and the second node, and the restoration transistor is configured to transmit the initialization signal to the anode of the light-emitting diode based on a third control signal;

the initialization transistor is configured to transmit the initialization signal to the second end of the restoration transistor and the first node based on the third control signal.

In the afore-mentioned pixel circuit, the pixel circuit further includes a restoration transistor, wherein the first end of the restoration transistor is connected to an anode of the light-emitting diode, the second end of the restoration transistor is connected to the initialization signal line, and the restoration transistor is configured to transmit a restoration signal input from the initialization signal line to the anode of the light-emitting diode based on a fourth control signal;

the compensation transistor is configured to enable the first end of the driving transistor and the control end of the driving transistor to be electrically connected based on the fourth control signal.

In the afore-mentioned pixel circuit, the pixel circuit further includes:

a switching transistor, wherein the first end of the switching transistor is connected to the second end of the driving transistor, the second end of the switching transistor is connected to a data signal line, and the switching transistor is configured to transmit a data signal input from the data signal line to the second end of the driving transistor based on a fourth control signal;

a first light-emitting control transistor, wherein the first end of the first light-emitting control transistor is connected to the second end of the driving transistor, the second end of the first light-emitting control transistor is connected to a power supply voltage signal line, the control end of the first light-emitting control transistor is connected to a light-emitting control signal line, and the first light-emitting control transistor is configured to transmit a power supply voltage input from the power supply voltage signal line to the second end of the drive transistor based on a light-emitting control signal at input from the light-emitting control signal line;

a second light-emitting control transistor, wherein the first end of the second light-emitting control transistor is connected to the first end of the driving transistor, the second end of the second light-emitting control transistor is connected to an anode of the light-emitting diode, the control end of the second light-emitting control transistor is connected to the light-emitting control signal line, and the second light-emitting control transistor is configured to transmit a driving current output from the driving transistor to the light-emitting diode based on the light-emitting control signal;

a storage capacitor, wherein the first end of the storage capacitor is connected to the first node, and the second end of the storage capacitor is connected to the power supply voltage signal line.

In the afore-mentioned pixel circuit, all the driving transistor, the switching transistor, the compensation transistor, the initialization transistor, the first light-emitting control transistor and the second light-emitting control transistor are P-type transistors having active layers with polysilicon.

A method for driving the afore-mentioned pixel circuit is provided, the method including the steps of:

in initialization phase, switching on the anti-leakage transistor, and switching on the initialization transistor to transmit an initialization signal to the first node;

in threshold voltage compensating and data writing phase, switching on the anti-leakage transistor, and switching on the compensation transistor to enable the first end of the driving transistor and the control end of the driving transistor to be electrically connected;

in light-emitting phase, switching off the anti-leakage transistor, the compensation transistor and the initialization transistor, and switching on the driving transistor to control the light-emitting diode to be in the light-emitting state.

A display device includes:

a light-emitting diode;

a driving transistor, configured to transmit a driving current to the light-emitting diode;

an initialization transistor, configured to transmit an initialization signal to a control end of the driving transistor;

a compensation transistor, configured to transmit a data signal with a compensated threshold voltage to the control end of the driving transistor; and an anti-leakage transistor, connected between the control end of the driving transistor and the initialization transistor and connected between the control end of the driving transistor and the compensation transistor, wherein the anti-leakage transistor includes an active layer with oxide semiconductor.

In the afore-mentioned display device, the anti-leakage transistor includes a first end connected to the control end of the driving transistor and a second end connected to the initialization transistor and the compensation transistor, and wherein the display device further includes a reset transistor, the reset transistor is connected to the second end of the anti-leakage transistor and is configured to be switched on based on a first control signal and transmit a fixed reference voltage signal to the second end of the anti-leakage transistor.

In the afore-mentioned display device, the anti-leakage transistor is configured to be in switched-off state based on the first control signal, and wherein the anti-leakage transistor is an N-type transistor and the reset transistor is a P-type transistor.

In the afore-mentioned display device, the control end of the reset transistor is connected to a light-emitting control signal line, and the first control signal is a light-emitting control signal input from the light-emitting control signal line.

In the afore-mentioned display device, the reset transistor includes an active layer with low-temperature polysilicon.

In the afore-mentioned display device, the anti-leakage transistor is configured to be in the switched-off state based on a second control signal when the light-emitting diode is in the light-emitting state;

the initialization transistor is configured to transmit the initialization signal to the control end of the driving transistor based on a third control signal;

the compensation transistor is configured to transmit the data signal with the compensated threshold voltage to the control end of the driving transistor based on a fourth control signal;

the first control signal, the second control signal, the third control signal, and the fourth control signal are different from each other.

In the afore-mentioned display device, the pixel circuit further includes a restoration transistor, a first end of the restoration transistor is connected to an anode of the light-emitting diode, a second end of the restoration transistor is connected to the first end of the initialization transistor, and the control end of the restoration transistor is configured to receive a third control signal;

the first end of the initialization transistor is connected to the second end of the restoration transistor, the control end of the initialization transistor is configured to receive the third control signal, and the second end of the initialization transistor is configured to receive the initialization signal.

In the afore-mentioned display device, the pixel circuit further includes a restoration transistor, a first end of the restoration transistor is connected to an anode of the light-emitting diode, a second end of the restoration transistor is connected to an initialization signal line, the control end of the restoration transistor is configured to receive a fourth control signal, and the control end of the initialization transistor is configured to receive a third control signal;

In the afore-mentioned display device, the display device further includes:

a switching transistor, connected to the driving transistor, wherein a second end of the switching transistor is connected to a data signal line, and the control end of the switching transistor is configured to receive a fourth control signal;

a first light-emitting control signal line, connected between the driving transistor and a power supply voltage signal line, wherein the control end of the first light-emitting control transistor is connected to a light-emitting control signal line;

a second light-emitting control signal line, connected between the driving transistor and an anode of the light-emitting diode, wherein the control end of the second light-emitting control transistor is connected to the light-emitting control signal line;

a storage capacitor, connected between the power supply voltage signal line and the control end of the driving transistor.

In the afore-mentioned display device, all the switching transistor, the compensation transistor, the initialization transistor, the first light-emitting control transistor and the second light-emitting control transistor are P-type transistors having active layers with polysilicon.

Beneficial Effects

The present application provides a pixel circuit, a driving method thereof and a display device. An anti-leakage transistor is added between the gate of the driving transistor and the initialization transistor and between the gate of the driving transistor and the compensation transistor. The anti-leakage transistor includes an active layer with oxide semiconductor. Low leakage property of a metal oxide transistor is utilized to suppress potential changes of the gate of the driving transistor during a light-emitting diode emits light. It is beneficial for reducing power consumption and low-frequency displaying.

DESCRIPTION OF EMBODIMENTS OF THE DISCLOSURE

Figure 1:
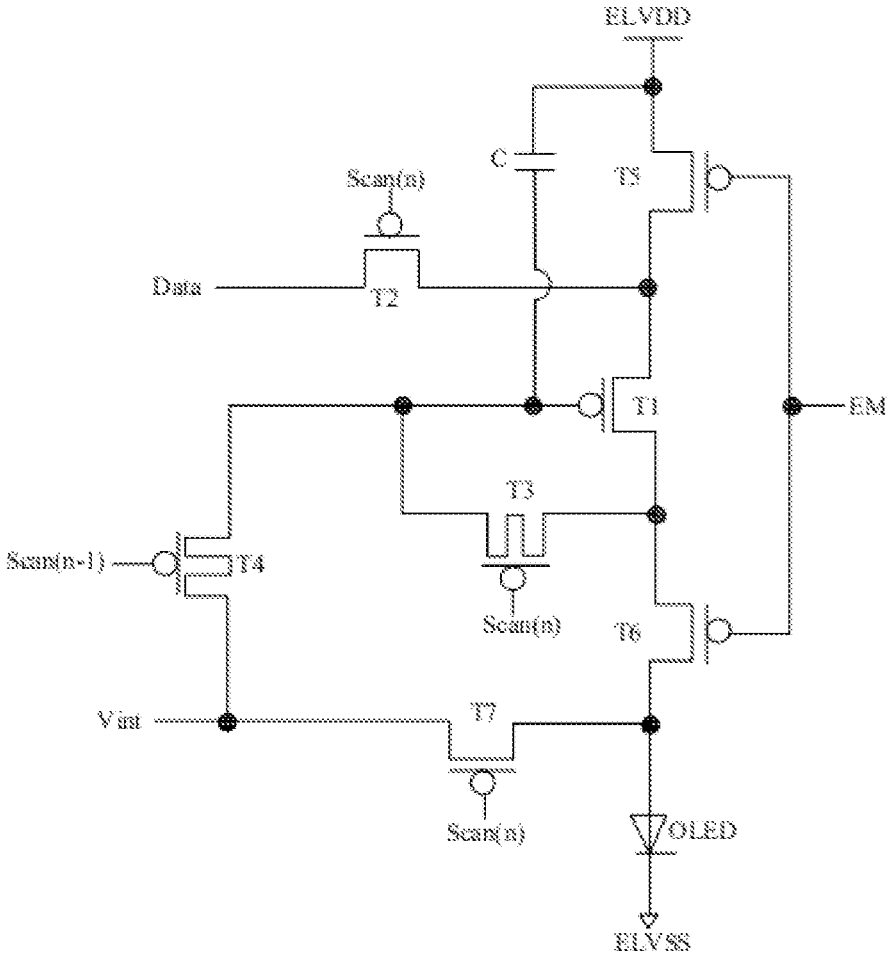
FIG. 1 (Prior Art)
FIG. 1 is an equivalent circuit diagram of a pixel circuit for a conventional signal pixel.

The technical solutions in the embodiments of the present application will be clearly and completely described below with reference to appended drawings of the embodiments of the present application. Obviously, the described embodiments are merely a part of embodiments of the present application and are not all of the embodiments. Based on the embodiments of the present application, all the other embodiments obtained by those of ordinary skill in the art without making any inventive effort are within the scope the present application.

The present application provides a display device. The display device is an organic light-emitting diode display device. The display device includes a data driver and an organic light-emitting diode display panel. The organic light-emitting diode display panel includes a display area and a border area at the periphery of the display area.

The display area of the organic light-emitting diode display panel is provided with a plurality of pixel circuits, a plurality of scan signal lines, a plurality of data lines, a plurality of initialization signal lines, a plurality of light-emitting control signal lines and a plurality of power supply signal lines. The border area of the organic light-emitting diode display panel is provided with a gate driving circuit. The gate driving circuit is configured to output scan signals, and the gate driving circuit is connected to the scan signal lines so as to output the scan signals to the scan signal lines. The data driver is configured to output data signals. The data driver is connected to the data lines so as to output the data signals to the data lines. A driving circuit for outputting light-emitting control signals is also disposed in the border area of the organic light-emitting diode display panel.

The initialization signal lines are configured to transmit signals such as initialization signals. The light-emitting control signal line are configured to transmit light-emitting control signals. The power supply signal lines include a first power supply voltage signal line and a second power supply voltage signal line. The first power supply voltage signal line is configured to transmit a first power supply voltage signal, and the second power supply voltage signal line is configured to transmit a second power supply voltage signal.

Each pixel circuit is configured to drive a sub-pixel to emit light. Each sub-pixel is an organic light-emitting diode. Each pixel circuit is connected with a data line, a scan signal line, an initialization signal line, a power signal line, and a light-emitting control signal line.

In the present embodiment, each pixel circuit includes a light-emitting diode, a driving transistor, a switching transistor, a compensation transistor, an initialization transistor, a first light-emitting control transistor, a second light-emitting control transistor, an anti-leakage transistor, a restoration transistor and a storage capacitor. Any of the driving transistor, the switching transistor, the compensation transistor, the initialization transistor, the first light-emitting control transistor, the second light-emitting control transistor, the anti-leakage transistor and the restoration transistor includes a first end, a second end, and a control end. The first end is one of the source and the drain, the second end is the other one of the source and the drain, and the control end is the gate. All the driving transistor, the switching transistor, the compensation transistor, the initialization transistor, the first light-emitting control transistor, the second light-emitting control transistor and the restoration transistor are P-type transistors having an active layer with low-temperature polysilicon. The anti-leakage transistor is an N-type transistor having an active layer with oxide semiconductor. Compared with a polysilicon transistor having a larger leakage current when it is in switched-off state, an oxide semiconductor transistor has a low-leakage property when it is in the switched-off state.

The light-emitting diode is an organic light-emitting diode. The light-emitting diode includes an anode, a cathode, and an organic light-emitting layer located between the cathode and the anode. The cathode of the light-emitting diode is connected to the second power supply voltage signal line.

The first end of the switching transistor is connected to the driving transistor, the second end of the switching transistor is connected to the data signal line, the control end of the switching transistor is configured to receive a fourth control signal, and the switching transistor is configured to transmit the data signal input from the data signal line to the driving transistor based on the fourth control signal. The fourth control signal is output from a second scan line. The control end of the switching transistor is connected to the second scan signal line.

The driving transistor is configured to transmit the driving current to the light-emitting diode to make the light-emitting diode emit light. The control end of the driving transistor is connected to the first end of the storage capacitor and the first end of the anti-leakage transistor, the first end of the driving transistor is connected to the anode of the light-emitting diode via the second light-emitting control transistor, and the second end of the driving transistor is connected to the first power supply voltage signal line via the first light-emitting control transistor.

The compensation transistor is configured to transmit the data signal with the compensated threshold voltage to the control end of the driving transistor. Specifically, the first end of the compensation transistor is connected to the first end of the driving transistor, the second end of the compensation transistor is connected to the second end of the anti-leakage transistor, the control end of the compensation transistor is connected to the second scan signal line, and the compensation transistor is configured to enable the control end of the driving transistor and the first end of the driving transistor to be electrically connected based on the fourth control signal input from the second scan signal line.

The anti-leakage transistor is connected between the control end of the driving transistor and the initialization transistor and is connected between the control end of the driving transistor and the compensation transistor. The anti-leakage transistor includes an active layer with oxide semiconductor. When the light-emitting diode is in the light-emitting state, the anti-leakage transistor is in the switched-off state. Since the anti-leakage transistor has the active layer with oxide semiconductor, the anti-leakage transistor has a lower leakage current when it is in the switched-off state. This avoids electric leakage since it prevents the potential of the control end of the driving transistor from passing through the anti-leakage transistor in the switched-off state. By use of the storage capacitor, the potential of the control end of the driving transistor is kept for one frame. It is beneficial for reducing power consumption and low-frequency displaying.

Specifically, the anti-leakage transistor includes the first end connected to the control end of the driving transistor and the second end connected to the initialization transistor and the compensation transistor. The anti-leakage transistor can be configured to be in the switched-off state based on a second control signal when the light-emitting diode is in the light-emitting state. The second control signal is output from a third scan line, and the control end of the anti-leakage transistor can be connected to the third scan signal line. The anti-leakage transistor can also be configured to be in the switched-off state based on a first control signal, that is, the first control signal is the same as the control signal of the reset transistor.

The reset transistor is connected to the second end of the anti-leakage transistor, and is configured to be switched on based on the first control signal and transmit a fixed reference voltage signal to the second end of the anti-leakage transistor, so as to improve that the second end of the anti-leakage transistor is in floating state when the light-emitting diode is in the light-emitting state.

Specifically, the control end of the reset transistor is connected to the light-emitting control signal line, and the first control signal is a light-emitting control signal input from the light-emitting control signal line. This is to avoid introducing other signal lines. The reset transistor includes an active layer with low-temperature polysilicon and is a P-type transistor.

In the present embodiment, the first end of the restoration transistor is connected to the anode of the light-emitting diode, the second end of the restoration transistor is connected to the first end of the initialization transistor, the control end of the restoration transistor is configured to receive a third control signal, and the restoration transistor is configured to reset the potential of the anode of the light-emitting diode based on the third control signal. The first end of the initialization transistor is connected to the second end of the anti-leakage transistor and the second end of the restoration transistor, the second end of the initialization transistor is configured to receive the initialization signal, the control end of the initialization transistor is configured to receive the third control signal, and the initialization transistor is configured to transmit the initialization signal to the control end of the driving transistor based on the third control signal, so that the control end of the driving transistor is initialized. In this way, the resetting of the potential of the anode of the light-emitting diode and the initialization of the control end of the driving transistor are carried out simultaneously. The third control signal is output from a first scan line, and the control end of the restoration transistor and the control end of the initialization transistor are connected to the first scan line.

In other embodiments, the first end of the restoration transistor is connected to the anode of the light-emitting diode, the second end of the restoration transistor is connected to the initialization signal line, the control end of the restoration transistor is configured to receive the fourth control signal, and the restoration transistor is configured to reset the potential of the anode of the light-emitting diode based on the fourth control signal. The first end of the initialization transistor is connected to the second end of the anti-leakage transistor, the second end of the initialization transistor is connected to the initialization signal line, and the control end of the initialization transistor is configured to receive the third control signal, and the initialization transistor is configured to initialize the control end of the driving transistor based on the third control signal. The control end of the initialization transistor is connected to the first scan signal line.

In the present embodiment, when the first control signal, the second control signal, the third control signal and the fourth control signal are different from each other, the anti-leakage transistor is controlled by an independent control signal.

The first light-emitting control transistor is connected between the driving transistor and the first power supply voltage signal line, and the control end of the first light-emitting control transistor is connected to the light-emitting control signal line. The first light-emitting control transistor is configured to control the time to output the first power supply voltage input from the first power supply voltage signal line to the driving transistor based on the light-emitting control signal input from the light-emitting control signal line.

The second light-emitting control transistor is connected between the driving transistor and the anode of the light-emitting diode, and the control end of the second light-emitting control transistor is connected to the light-emitting control signal line. The second light-emitting control transistor is configured to control the time to output the driving current output from the driving transistor to the light-emitting diode based on the light-emitting control signal input from the light-emitting control signal line.

The storage capacitor is connected between the first power supply voltage signal line and the control end of the driving transistor, and is configured to maintain the voltage difference between the first power supply voltage and the voltage of the control end of the driving transistor.

The afore-mentioned pixel circuit will be described in detail below in conjunction with specific embodiments.

First Embodiment

Figure 2:
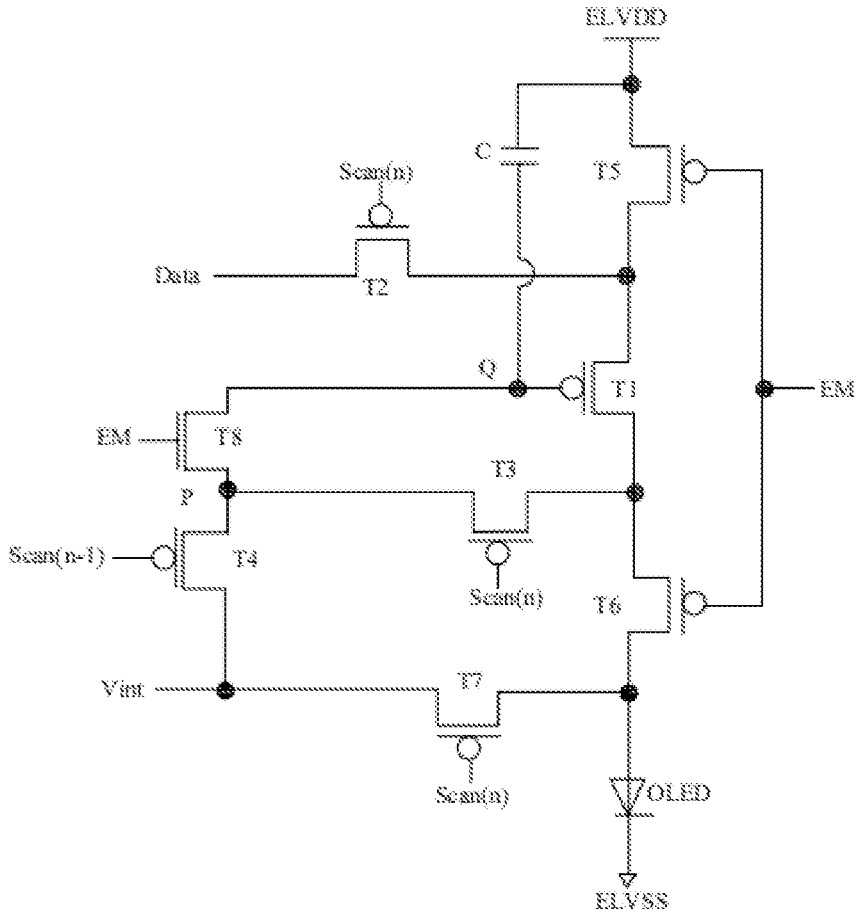
FIG. 2 is an equivalent circuit diagram of a pixel circuit for a signal pixel according to a first embodiment of the present application.

FIG. 2 is an equivalent circuit diagram of a pixel circuit for a signal pixel according to a first embodiment of the present application. The pixel circuit includes a driving transistor T1, a switching transistor T2, a compensation transistor T3, an initialization transistor T4, a first light-emitting control transistor T5, a second light-emitting control transistor T6, a restoration transistor T7, an anti-leakage transistor T8, a storage capacitor C and an organic light-emitting diode OLED.

The organic light-emitting diode OLED includes an anode and a cathode, and the anode of the organic light-emitting diode OLED is connected to the second end of the second light-emitting control transistor T6 and the second end of the restoration transistor T7. The cathode of the organic light-emitting diode OLED is connected to the second power supply voltage end ELVSS. The second power supply voltage end ELVSS is configured to load a second power supply voltage, and the second power supply voltage end ELVSS is connected to the second power supply voltage signal line.

The first end of the storage capacitor C is connected to the first node Q, the second end of the storage capacitor C is connected to the first power supply voltage end ELVDD, and the first power supply voltage end ELVDD is configured to load a first power supply voltage. The first power supply voltage end ELVDD is connected to the first power supply voltage signal line. The storage capacitor C is configured to maintain the potential of the first node Q, so that the organic light-emitting diode OLED can emit light during one frame.

The first end of the driving transistor T1 is connected to the anode of the organic light-emitting diode OLED via the second light-emitting control transistor T6, to enable the first end of the driving transistor T1 and the organic light-emitting diode OLED to be electrically connected. The control end of the driving transistor T1 is connected to the first node Q, the first end of the storage capacitor C, and the first end of the anti-leakage transistor T8. The second end of the driving transistor T1 is connected to the first power supply voltage end ELVDD via the first light-emitting control transistor T5, and the second end of the driving transistor T1 is connected to the first end of the switching transistor T1. The driving transistor T1 is configured to control operation state of the organic light-emitting diode OLED based on the potential of the first node Q.

The control end of the switching transistor T2 is connected to the second scan signal end Scan(n), and the first end of the switching transistor T2 is connected to the second end of the driving transistor T1, the second end of the switching transistor T2 is connected to the data signal end Data. The second scan signal end Scan(n) is connected to the second scan line and is configured to load the second scan signal, and the data signal end Data is connected to the data line and is configured to load the data signal, where n is an integer greater than or equal to 2. The switching transistor T2 is configured to transmit the data signal to the second end of the driving transistor T1 based on the second scan signal.

The control end of the compensation transistor T3 is connected to the second scan signal end Scan(n), the first end of the compensation transistor T3 is connected to the first end of the driving transistor T1, and the second end of the compensation transistor T3 is connected to the second node P. The compensation transistor T3 is configured to enable the first end and the control end of the driving transistor T1 to be electrically connected based on the second scan signal input from the second scan signal line.

The control end of the initialization transistor T4 is connected to the first scan signal end Scan(n−1), the first end of the initialization transistor T4 is connected to the second node P, and the second end of the initialization transistor T4 is connected to the initialization signal end Vint. The first scan signal end Scan(n−1) is connected to the first scan signal line and is configured to load the first scan signal, and the initialization signal end Vint is connected to the initialization signal line and is configured to load the initialization signal. The initialization transistor T4 is configured to transmit the initialization signal to the first node Q via the switched-on anti-leakage transistor T8 based on the first scan signal, so as to initialize the potential of the first node Q.

The control end of the first light-emitting control transistor T5 is connected to the light-emitting control signal end EM, the first end of the first light-emitting control transistor T5 is connected to the second end of the driving transistor T1, and the second end of the first light-emitting control transistor T5 is connected to the first power supply voltage end ELVDD. The light-emitting control signal end EM is connected to the light-emitting control signal line and is configured to load the light-emitting control signal. The first light-emitting control transistor T5 is configured to transmit the first power supply voltage to the second end of the driving transistor T1 based on the light-emitting control signal.

The control end of the second light-emitting control transistor T6 is connected to the light-emitting control signal end EM, the first end of the second light-emitting control transistor T6 is connected to the first end of the driving transistor T1, and the second end of the second light-emitting control transistor T6 is connected to the anode of the organic light-emitting diode OLED. The second light-emitting control transistor T6 is configured to transmit the driving current output from the driving transistor T1 to the organic light-emitting diode OLED based on the light-emitting control signal input from the light-emitting control signal line.

The control end of the restoration transistor T7 is connected to the second scan signal end Scan(n), the first end of the restoration transistor T7 is connected to the anode of the organic light-emitting diode OLED, and the second end of the restoration transistor T7 is connected to the initialization signal end Vint. The restoration transistor T7 is configured to transmit the reset signal to the anode of the organic light-emitting diode based on the second scan signal input from the second scan signal line. The initialization signal end Vin is connected to the initialization signal line and is also configured to input the reset signal.

The control end of the anti-leakage transistor T8 is connected to the light-emitting control signal end EM, the first end of the anti-leakage transistor T8 is connected to the first node Q, and the second end of the anti-leakage transistor T8 is connected to the second node P, that is, the anti-leakage transistor T8 is connected between the control end of the driving transistor T1 and the initialization transistor T4 and is connected between the control end of the driving transistor T1 and the compensation transistor T3. The anti-leakage transistor T8 is configured to be in the switched-off state based on the light-emitting control signal input from the light-emitting control signal line when the light-emitting diode is in the light-emitting state. The anti-leakage transistor T8 includes an active layer with oxide semiconductor. Since an oxide-semiconductor thin-film transistor has a low-leakage property when it is switched off, it can suppress variations of the potential of the first node Q and avoid variations of the potential of the first node Q caused by electric leakage from the initialization transistor T4 and the compensation transistor T3, when the driving transistor T1 drives the organic light-emitting diode OLED to emit light.

In the present embodiment, all the driving transistor T1, the switching transistor T2, the compensation transistor T3, the initialization transistor T4, the first light-emitting control transistor T5, the second light-emitting control transistor T6 and the restoration transistor T7 are all P-type transistors having an active layer with polysilicon. The anti-leakage transistor T8 is an N-type transistor. The control end of the N-type transistor is switched on in response to high voltage level and is switched off in response to low voltage level. The control end of the P-type transistor is switched off in response to high voltage level and is switched on in response to low voltage level.

Figure 3:
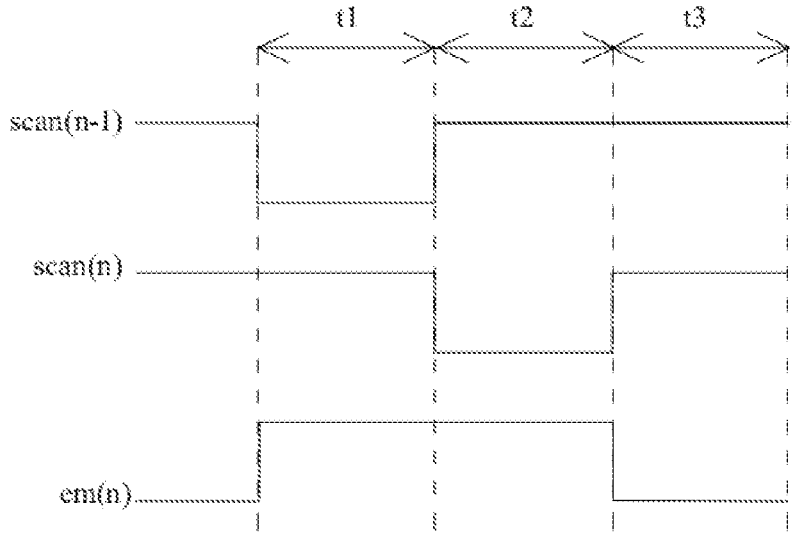
FIG. 3 is a timing diagram corresponding to the equivalent circuit diagram shown in FIG. 2.

FIG. 3 is a timing diagram corresponding to the equivalent circuit diagram shown in FIG. 2. The driving method of the pixel circuit shown in FIG. 2 includes the following steps:

In initialization phase t1, the first scan signal line transmits the first scan signal scan(n−1) of low voltage level to the first scan signal end Scan(n−1), the second scan signal line transmits the second scan signal scan(n) of high voltage level to the second scan signal end Scan(n), the light-emitting control signal line transmits the light-emitting control signal em(n) of high voltage level to the light-emitting control signal end EM, the initialization transistor T4 and the anti-leakage transistor T8 are switched on, the driving transistor T1, the switching transistor T2, the compensation transistor T3, the first light-emitting control transistor T5, the second light-emitting control transistor T6 and the restoration transistor T7 are all switched off, the initialization transistor T4 transmits the initialization signal input from the initialization signal line to the first node Q via the switched-on anti-leakage transistor T8, so as to realize the initialization of the first node Q.

In threshold voltage compensating and data writing phase t2, the first scan signal line transmits the first scan signal scan(n−1) of high voltage level to the first scan signal end Scan(n−1), the second scan signal line transmits the second scan signal scan(n) of low voltage level to the second scan signal end Scan(n), the light-emitting control signal line transmits the light-emitting control signal em(n) of high voltage level to the light-emitting control signal end EM, the compensation transistor T3, the switching transistor T2, the restoration transistor T7 and the anti-leakage transistor T8 are all switched on, and the driving transistor T1, the initialization transistor T4, the first light-emitting control transistor T5 and the second light-emitting control transistor T6 are all switched off. Since both the compensation transistor T3 and the anti-leakage transistor T8 are switched on, the first end of the driving transistor T1 and the control end of the driving transistor are electrically connected via the switched-on compensation transistor T3 and the switched-on anti-leakage transistor T8. The switching transistor T2 transmits the data signal input from the data signal end Data to the second end of the driving transistor T1. The restoration transistor T7 transmits the reset signal input from the initialization signal end Vint to the anode of the organic light-emitting diode OLED, so as to reset the potential of the anode of the organic light-emitting diode OLED.

In light-emitting phase t3, the first scan signal line transmits the first scan signal scan(n−1) of high voltage level to the first scan signal end Scan(n−1), the second scan signal line transmits the second scan signal scan(n) of high voltage level to the second scan signal end Scan(n), the light-emitting control signal line transmits the light-emitting control signal em(n) of low voltage level to the light-emitting control signal end EM, the switch transistor T2, the initial transistor T4, the compensation transistor T3, the restoration transistor T7 and the anti-leakage transistor T8 are all switched off, and the first light-emitting control transistor T5 and the second light-emitting control transistor T6 are switched on. The driving transistor T1 generates the driving current under the action of the voltage difference between the voltage of the first node Q and the voltage of the second end of the driving transistor T1. The driving current is transmitted to the organic light-emitting diode OLED via the second light-emitting control transistor T6 to enable the organic light-emitting diode OLED to emit light. When the organic light-emitting diode OLED emits light, the capacitor C maintains the potential of the first node Q.

In the pixel circuit of the present embodiment, the anti-leakage transistor is added between the gate of the driving transistor and the initialization transistor and between the gate of the driving transistor and the compensation transistor. The anti-leakage transistor includes an active layer with oxide semiconductor. The metal oxide transistor has low-leakage property when it is switched off. By the deployment of position of the anti-leakage transistor and a property that the anti-leakage transistor is in the switched-off state when the organic light-emitting diode is in the light-emitting state, it can be suppressed variations of the potential of the gate of the driving transistor during the light-emitting diode emits light, and it prevents the gate of the driving transistor from electric leakage via the initialization transistor and the compensation transistor. It is beneficial for reducing power consumption and realizing low-frequency displaying. The flickers are avoided when the display device displays images. The display effect of the display device is improved. In addition, the anti-leakage transistor is selected as N-type, and the control signal of the anti-leakage transistor is a light-emitting control signal, so that control signals of the first light-emitting control transistor T5, the second light-emitting control transistor T6 and the anti-leakage transistor T8 of the pixel circuit of the present embodiment are the same. Driving circuits outputting same light-emitting control signals can be adopted for the driving so as to reduce the number of driving circuits. Generally, the drive circuits that output the light-emitting control signals are disposed in the border area of the display device. Reducing the number of drive circuits is beneficial to reduce the layout space of the border area of the display device. It is beneficial to realize a narrow bezel.

Second Embodiment

Figure 4:
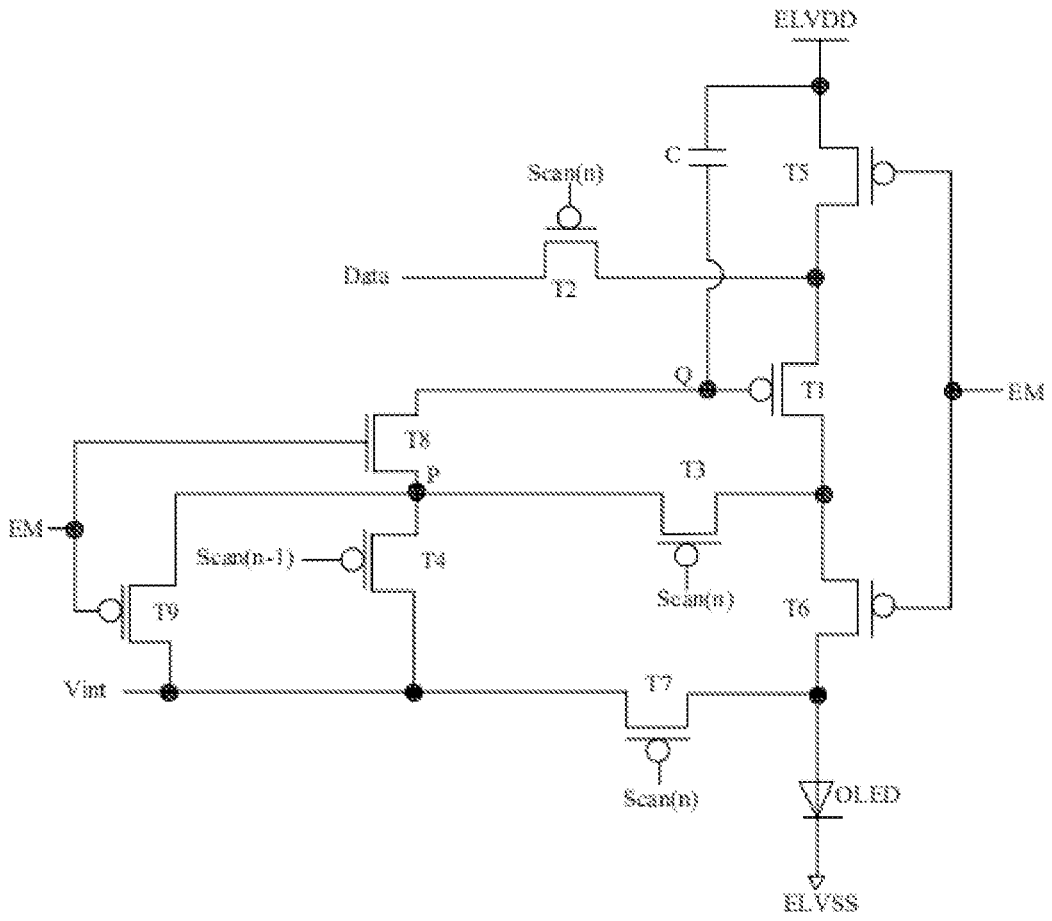
FIG. 4 is an equivalent circuit diagram of a pixel circuit for a signal pixel according to a second embodiment of the present application.

FIG. 4 is an equivalent circuit diagram of a pixel circuit for a signal pixel according to a second embodiment of the present application. The pixel circuit of the second embodiment is basically similar to the pixel circuit of the first embodiment. Their differences are that the pixel circuit of the second embodiment further includes a reset transistor T9. The control end of the reset transistor T9 is connected to the first control signal input end. The first end of the reset transistor T9 is connected to the second node P. The second end of the reset transistor T9 is connected to the initialization signal end Vint, and the initialization signal end Vint is connected to the initialization signal line. The reset transistor T9 is configured to be switched on based on the first control signal and transmit a fixed reference voltage to the second node P when the organic light-emitting diode OLED is in the light-emitting state.

In the present embodiment, the reset transistor T9 includes an active layer with low-temperature polysilicon, and the reset transistor T9 is a P-type transistor.

In the present embodiment, the first control signal input end is the light-emitting control signal end EM, the first control signal is the light-emitting control signal, and the light-emitting control signal end EM is connected to the light-emitting control signal line. The light-emitting control signal controls the reset transistor T9 to be switched on and controls the anti-leakage transistor T8 to be switched off. This is beneficial in the pixel circuit of the present embodiment for using a same driving circuit to output the light-emitting control signal that controls the reset transistor T9 and the anti-leakage transistor T8. It is beneficial for the display device to realize a narrow bezel.

During driving the pixel circuit, the potential of the second node P will vary as the operation state of surrounding transistors (T3, T4, and T8) changes. When the organic light-emitting diode OLED is in the light-emitting state, the potential of the second node P may be in floating state. By setting the potential of the second node P as the fixed reference voltage via the reset transistor T9 when the organic light-emitting diode OLED is in the light-emitting state, it can prevent the anti-leakage transistor T8 from being switched on so as to cause electric leakage from the first node Q via the initialization transistor T4 and the compensation transistor T3 when the potential of the second node P is in the floating state. Hence, it is avoided the flicker problem occurred during the organic light-emitting diode emits light.

The time of the pixel circuit of the present embodiment is the same as that shown in FIG. 3. The driving further includes the follows. In the light-emitting phase, the reset transistor T9 is switched on, and the fixed reference voltage input from the initialization signal end Vint is transmitted to the second node P, so that the potential of the second node P is fixed to prevent the potential of the second node P from being in the floating state.

Third Embodiment

Figure 5:
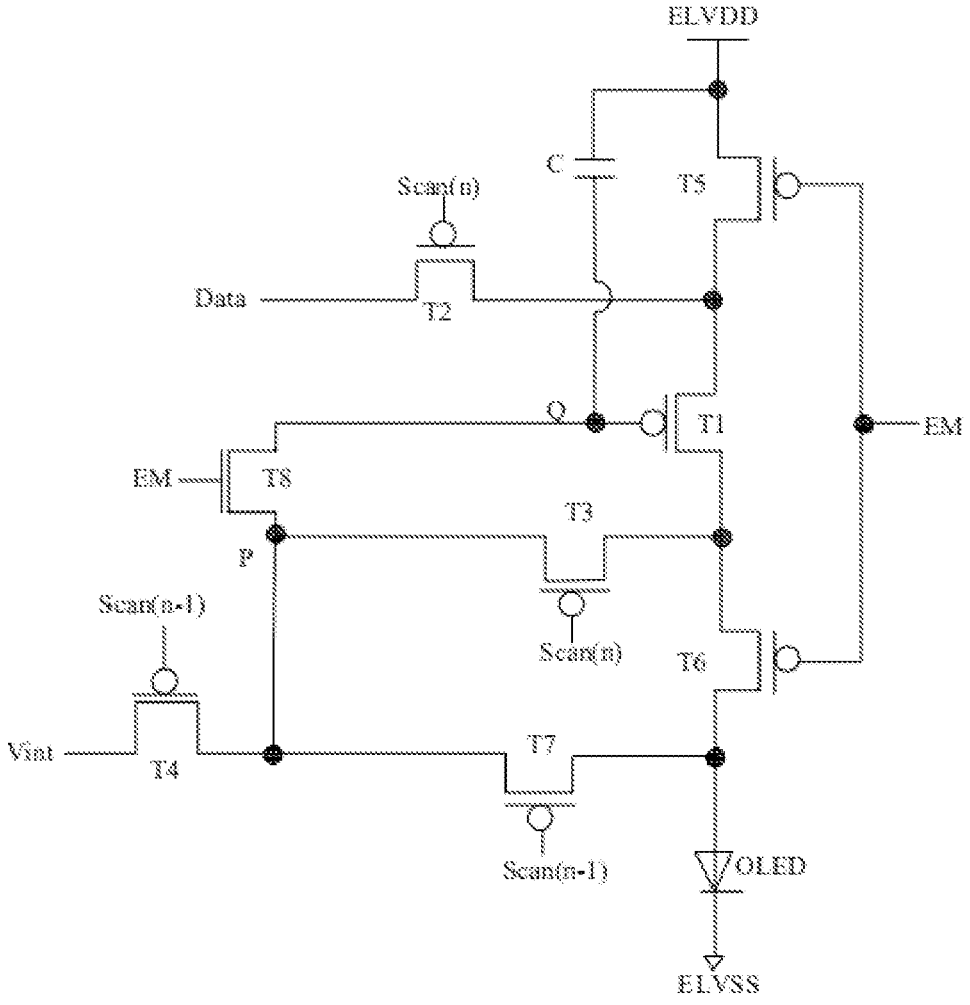
FIG. 5 is an equivalent circuit diagram of a pixel circuit for a signal pixel according to a third embodiment of the present application.

FIG. 5 is an equivalent circuit diagram of a pixel circuit for a signal pixel according to a third embodiment of the present application. The pixel circuit of the third embodiment is basically similar to the pixel circuit of the first embodiment. Their differences are that the restoration transistor T7 and the initialization transistor T4 are connected in different ways. The control end of the restoration transistor T7 is connected to the first scan signal end Scan(n−1), the first end of the restoration transistor T7 is connected to the anode of the organic light-emitting diode OLED, and the second end of the restoration transistor T7 is connected to the first end of the initialization transistor T4 and the second node P. The restoration transistor T7 is configured to transmit the initialization signal to the anode of the organic light-emitting diode based on the first scan signal input from the first scan signal end.

The driving process of the pixel circuit of the present embodiment is basically similar to the driving process of the pixel circuit of the first embodiment. Their differences are that in the initialization phase, the restoration transistor T7 is switched on and transmits the initialization signal, transmitted by the initialization transistor T4 to the second end of the restoration transistor T7, to the anode of the organic light-emitting diode OLED.

It should be noted that the solution of the present embodiment can also be applied to the first embodiment and the second embodiment.

Fourth Embodiment

Figure 6:
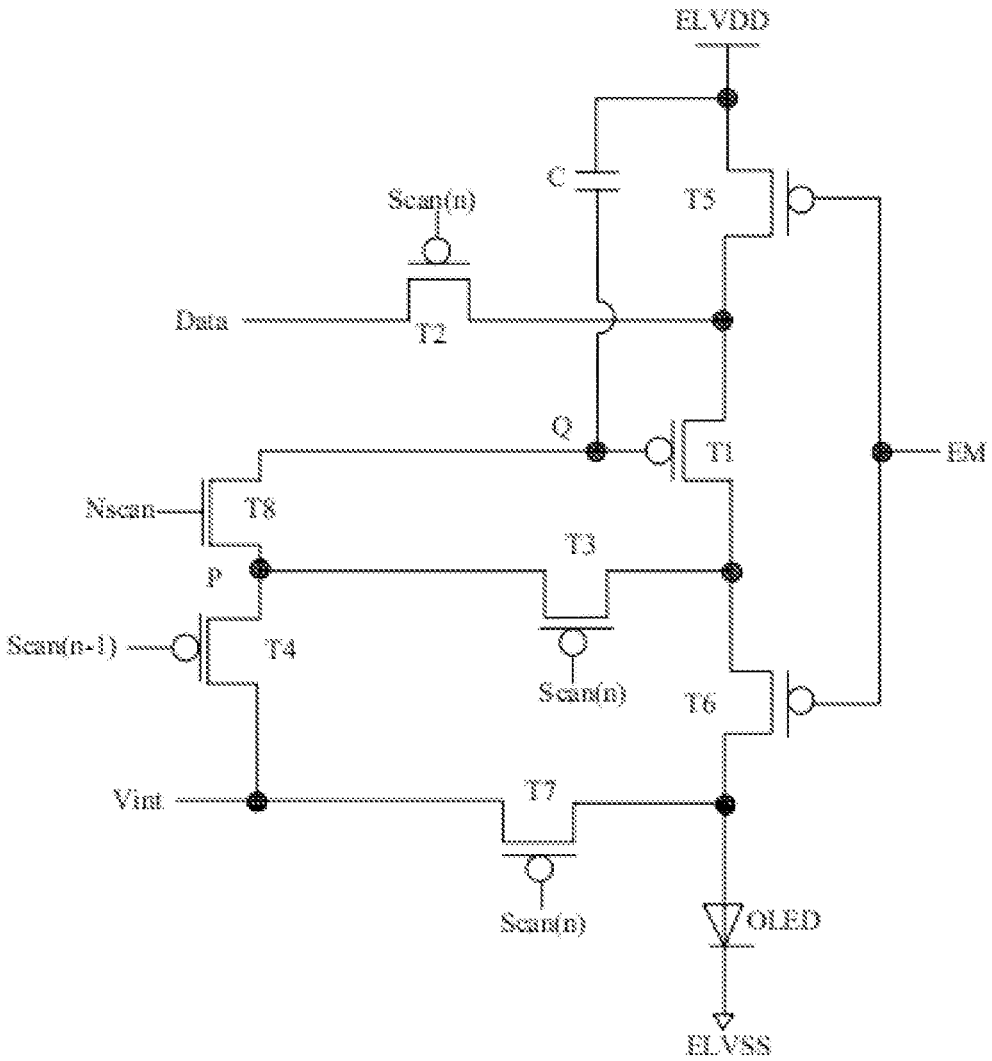
FIG. 6 is an equivalent circuit diagram of a pixel circuit for a signal pixel according to a fourth embodiment of the present application.

FIG. 6 is an equivalent circuit diagram of a pixel circuit for a signal pixel according to a fourth embodiment of the present application. The pixel circuit of the fourth embodiment is basically similar to the pixel circuit of the first embodiment. Their differences are that the control end of the anti-leakage transistor T8 is connected to the third scan signal end Nscan, and the third scan signal end Nscan is connected to the third scan signal line for inputting the third scan signal, that is, the control end of the anti-leakage transistor T8 is connected to the third scan signal line. When the third scan signal is at high voltage level, the anti-leakage transistor T8 is switched on; when the third scan signal is at low voltage level, the anti-leakage transistor T8 is switched off.

In the present embodiment, the third scan signal, the first scan signal, the second scan signal and the light-emitting control signal are different from each other.

The driving process corresponding to the pixel circuit of the present embodiment is basically similar to that of the first embodiment. Their differences are that the third scan signal is at high voltage level during the initialization phase t1, is at high voltage level during the threshold voltage compensating and data writing phase t2, and is at low voltage level during the light-emitting phase t3.

It can be seen from the first embodiment to the fourth embodiment that the anti-leakage transistor T8 can be controlled by an independent control signal, or can be controlled by the light-emitting control signal.

The descriptions of above embodiments are only used to help understand the technical solutions and core ideas of the present application. Those having ordinary skill in the art should understand that they still can modify technical solutions recited in the aforesaid embodiments or equivalently replace partial technical features therein; these modifications or substitutions do not make essence of corresponding technical solutions depart from the spirit and scope of technical solutions of embodiments of the present application.

The invention claimed is:

1. A pixel circuit, comprising:

a light-emitting diode;

a driving transistor, wherein a first end of the driving transistor is electrically connected to the light-emitting diode, a control end of the driving transistor is connected to a first node, and the driving transistor is configured to control operation state of the light-emitting diode based on a potential of the first node;

an anti-leakage transistor, wherein the first end of the anti-leakage transistor is connected to the first node, a second end of the anti-leakage transistor is connected to a second node, and the anti-leakage transistor comprises an active layer with oxide semiconductor and is in switched-off state when the light-emitting diode is in light-emitting state;

an initialization transistor, wherein the first end of the initialization transistor is connected to the second node, the second end of the initialization transistor is connected to an initialization signal line, and the initialization transistor is configured to transmit an initialization signal input from the initialization signal line to the first node;

a compensation transistor, wherein the first end of the compensation transistor is connected to the first end of the driving transistor, the second end of the compensation transistor is connected to the second node, and the compensation transistor is configured to enable the first end of the driving transistor and the control end of the driving transistor to be electrically connected; and a restoration transistor, wherein the first end of the restoration transistor is connected to an anode of the light-emitting diode, the second end of the restoration transistor is connected to the first end of the initialization transistor and the second node, and the restoration transistor is configured to transmit the initialization signal to the anode of the light-emitting diode based on a third control signal, wherein the initialization transistor is configured to transmit the initialization signal to the second end of the restoration transistor and the first node based on the third control signal.

2. The pixel circuit according to claim 1, wherein the anti-leakage transistor is configured to be in the switched-off state based on a first control signal when the light-emitting diode is in the light-emitting state, and wherein the anti-leakage transistor is an N-type transistor and the initialization transistor is a P-type transistor.

3. The pixel circuit according to claim 1, wherein the anti-leakage transistor is configured to be in the switched-off state based on a second control signal when the light-emitting diode is in the light-emitting state;

the initialization transistor is configured to transmit the initialization signal input from the initialization signal line to the first node based on the third control signal;

the compensation transistor is configured to enable the first end of the driving transistor and the control end of the driving transistor to be electrically connected based on a fourth control signal;

the second control signal, the third control signal, and the fourth control signal are different from each other.

4. The pixel circuit according to claim 1, further comprising:

a switching transistor, wherein the first end of the switching transistor is connected to the second end of the driving transistor, the second end of the switching transistor is connected to a data signal line, and the switching transistor is configured to transmit a data signal input from the data signal line to the second end of the driving transistor based on a fourth control signal;

a first light-emitting control transistor, wherein the first end of the first light-emitting control transistor is connected to the second end of the driving transistor, the second end of the first light-emitting control transistor is connected to a power supply voltage signal line, the control end of the first light-emitting control transistor is connected to a light-emitting control signal line, and the first light-emitting control transistor is configured to transmit a power supply voltage input from the power supply voltage signal line to the second end of the drive transistor based on a light-emitting control signal at input from the light-emitting control signal line;

a second light-emitting control transistor, wherein the first end of the second light-emitting control transistor is connected to the first end of the driving transistor, the second end of the second light-emitting control transistor is connected to the anode of the light-emitting diode, the control end of the second light-emitting control transistor is connected to the light-emitting control signal line, and the second light-emitting control transistor is configured to transmit a driving current output from the driving transistor to the light-emitting diode based on the light-emitting control signal;

a storage capacitor, wherein the first end of the storage capacitor is connected to the first node, and the second end of the storage capacitor is connected to the power supply voltage signal line.

5. The pixel circuit according to claim 4, wherein all the driving transistor, the switching transistor, the compensation transistor, the initialization transistor, the first light-emitting control transistor and the second light-emitting control transistor are P-type transistors having active layers with polysilicon.

6. A method for driving the pixel circuit according to claim 1, comprising the steps of:

in initialization phase, switching on the anti-leakage transistor, and switching on the initialization transistor to transmit an initialization signal to the first node;

in threshold voltage compensating and data writing phase, switching on the anti-leakage transistor, and switching on the compensation transistor to enable the first end of the driving transistor and the control end of the driving transistor to be electrically connected;

in light-emitting phase, switching off the anti-leakage transistor, the compensation transistor and the initialization transistor, and switching on the driving transistor to control the light-emitting diode to be in the light-emitting state.

7. A display device, comprising:

a light-emitting diode;

a driving transistor, configured to transmit a driving current to the light-emitting diode;

an initialization transistor, configured to transmit an initialization signal to a control end of the driving transistor;

a compensation transistor, configured to transmit a data signal with a compensated threshold voltage to the control end of the driving transistor;

an anti-leakage transistor, connected between the control end of the driving transistor and the initialization transistor and connected between the control end of the driving transistor and the compensation transistor, wherein the anti-leakage transistor comprises an active layer with oxide semiconductor; and a restoration transistor, a first end of the restoration transistor is connected to an anode of the light-emitting diode, a second end of the restoration transistor is connected to the first end of the initialization transistor, and the control end of the restoration transistor is configured to receive a third control signal, wherein the first end of the initialization transistor is connected to the second end of the restoration transistor, the control end of the initialization transistor is configured to receive the third control signal, and the second end of the initialization transistor is configured to receive the initialization signal.

8. The display device according to claim 7, wherein the anti-leakage transistor is configured to be in switched-off state based on a first control signal, and wherein the anti-leakage transistor is an N-type transistor and the initialization transistor is a P-type transistor.

9. The display device according to claim 7, wherein the anti-leakage transistor is configured to be in switched-off state based on a second control signal when the light-emitting diode is in light-emitting state;

the initialization transistor is configured to transmit the initialization signal to the control end of the driving transistor based on the third control signal;

the compensation transistor is configured to transmit the data signal with the compensated threshold voltage to the control end of the driving transistor based on a fourth control signal;

the second control signal, the third control signal, and the fourth control signal are different from each other.

10. The display device according to claim 7, further comprising:

a switching transistor, connected to the driving transistor, wherein the second end of the switching transistor is connected to a data signal line, and the control end of the switching transistor is configured to receive a fourth control signal;

a first light-emitting control signal line, connected between the driving transistor and a power supply voltage signal line, wherein the control end of the first light-emitting control transistor is connected to a light-emitting control signal line;

a second light-emitting control signal line, connected between the driving transistor and the anode of the light-emitting diode, wherein the control end of the second light-emitting control transistor is connected to the light-emitting control signal line;

a storage capacitor, connected between the power supply voltage signal line and the control end of the driving transistor.

11. The display device according to claim 10, wherein all the switching transistor, the compensation transistor, the initialization transistor, the first light-emitting control transistor and the second light-emitting control transistor are P-type transistors having active layers with polysilicon.

* * * * *